US005802730A

United States Patent [19]

Gomes

[11] Patent Number: 5,802,730

[45] Date of Patent: Sep. 8, 1998

[54] BAT

[76] Inventor: Robert A. Gomes, 5125 E. La. #113, Fresno, Calif. 93727

[21] Appl. No.: 764,066

[22] Filed: Nov. 6, 1996

[51] Int. Cl.[6] ..... B43L 7/033

[52] U.S. Cl. ..... 33/481; 33/482; 33/562

[58] Field of Search ..... 33/1 G, 21.1, 32.1, 33/32.2, 407, 429, 474, 481, 482, 562, 567

[56] References Cited

U.S. PATENT DOCUMENTS

| | | | |
|---|---|---|---|
| 351,820 | 11/1886 | Ward | 33/481 |
| 904,003 | 11/1908 | Naldrett | 33/481 |
| 1,097,393 | 5/1914 | Criswell | 33/481 |
| 1,545,424 | 7/1925 | Heimrich | 33/562 |
| 2,655,729 | 10/1953 | Panske | 33/481 |
| 2,666,260 | 1/1954 | Schneider et al. | 33/407 |
| 3,228,890 | 7/1967 | Fagerberg, Sr. | 33/474 |
| 4,936,020 | 6/1990 | Neblett | 33/1 G |
| 5,142,787 | 9/1992 | Dadisman | 33/1 G |
| 5,349,758 | 9/1994 | Bear | 33/429 |
| 5,720,114 | 2/1998 | Guerin | 33/474 |

*Primary Examiner*—G. Bradley Bennett

[57] ABSTRACT

A new Bat for measuring and facilitating marking the interior surfaces of an angled work piece, such as angle iron, which cannot be measured or marked by a conventional square because of arcuate corners and formed edges. The inventive device includes a first plate having a slanted edge, a first member secured to the first plate, a second member secured to the first member forming a syncline shape or V-shape which receives the arcuate corners and formed edges, and a second plate secured to said second member where the second plate is orthogonally aligned with respect to the first plate.

11 Claims, 3 Drawing Sheets

BAT

BACKGROUND OF THE INVENTION

1. Field of the Invention

The present invention relates to Layout Tools and more particularly pertains to a new Bat for measuring and facilitating marking the interior surfaces of an angled work piece, such as angle iron, which cannot be measured or marked by a conventional square because of arcuate corners and formed edges.

2. Description of the Prior Art

The use of Layout Tools is known in the prior art. More specifically, Layout Tools heretofore devised and utilized are known to consist basically of familiar, expected and obvious structural configurations, notwithstanding the myriad of designs encompassed by the crowded prior art which have been developed for the fulfillment of countless objectives and requirements.

Known prior art Layout Tools include U.S. Pat. No. 4,574,492; U.S. Pat. No. 4,404,753; U.S. Design Pat. No. 306,980; U.S. Pat. No. 5,020,233; U.S. Design Pat. No. 318,433 and U.S. Pat. No. 5,419,054.

While these devices fulfill their respective, particular objectives and requirements, the aforementioned patents do not disclose a new Bat. The inventive device includes a first plate having a slanted edge, a first member secured to the first plate, a second member secured to the first member forming a syncline shape which receives the arcuate corners and formed edges, and a second plate secured to said second member where the second plate is orthogonally aligned with respect to the first plate.

In these respects, the Bat according to the present invention substantially departs from the conventional concepts and designs of the prior art, and in so doing provides an apparatus primarily developed for the purpose of measuring and facilitating marking the interior surfaces of an angled work piece, such as angle iron, which cannot be measured or marked by a conventional square because of arcuate corners and formed edges.

SUMMARY OF THE INVENTION

In view of the foregoing disadvantages inherent in the known types of Layout Tools now present in the prior art, the present invention provides a new Bat construction wherein the same can be utilized for measuring and facilitating marking the interior surfaces of an angled work piece, such as angle iron, which cannot be measured or marked by a conventional square because of arcuate corners and formed edges.

The general purpose of the present invention, which will be described subsequently in greater detail, is to provide a new Bat apparatus and method which has many of the advantages of the Layout Tools mentioned heretofore and many novel features that result in a new Bat which is not anticipated, rendered obvious, suggested, or even implied by any of the prior art Layout Tools, either alone or in any combination thereof.

To attain this, the present invention generally comprises a first plate having a slanted edge, a first member secured to the first plate, a second member secured to the first member forming a syncline shape which receives the arcuate corners and formed edges, and a second plate secured to said second member where the second plate is orthogonally aligned with respect to the first plate.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Bat apparatus and method which has many of the advantages of the Layout Tools mentioned heretofore and many novel features that result in a new Bat which is not anticipated, rendered obvious, suggested, or even implied by any of the prior art Layout Tools, either alone or in any combination thereof.

It is another object of the present invention to provide a new Bat which may be easily and efficiently manufactured and marketed.

It is a further object of the present invention to provide a new Bat which is of a durable and reliable construction.

An even further object of the present invention is to provide a new Bat which is susceptible of a low cost of manufacture with regard to both materials and labor, and which accordingly is then susceptible of low prices of sale to the consuming public, thereby making such Bat economically available to the buying public.

Still yet another object of the present invention is to provide a new Bat which provides in the apparatuses and methods of the prior art some of the advantages thereof, while simultaneously overcoming some of the disadvantages normally associated therewith.

Still another object of the present invention is to provide a new Bat for measuring and facilitating marking the interior surfaces of an angled work piece, such as angle iron, which cannot be measured or marked by a conventional square because of arcuate corners and formed edges.

Yet another object of the present invention is to provide a new Bat which includes a first plate having a slanted edge, a first member secured to the first plate, a second member secured to the first member forming a syncline shape which receives the arcuate corners and formed edges, and a second plate secured to said second member where the second plate is orthogonally aligned with respect to the first plate.

Still yet another object of the present invention is to provide a new Bat that is utilized to layout angles, straight lines, measurements on most surfaces such as U, H, and I-shaped beams.

Even still another object of the present invention is to provide a new Bat that makes layout on irregular shapes fast and simple.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
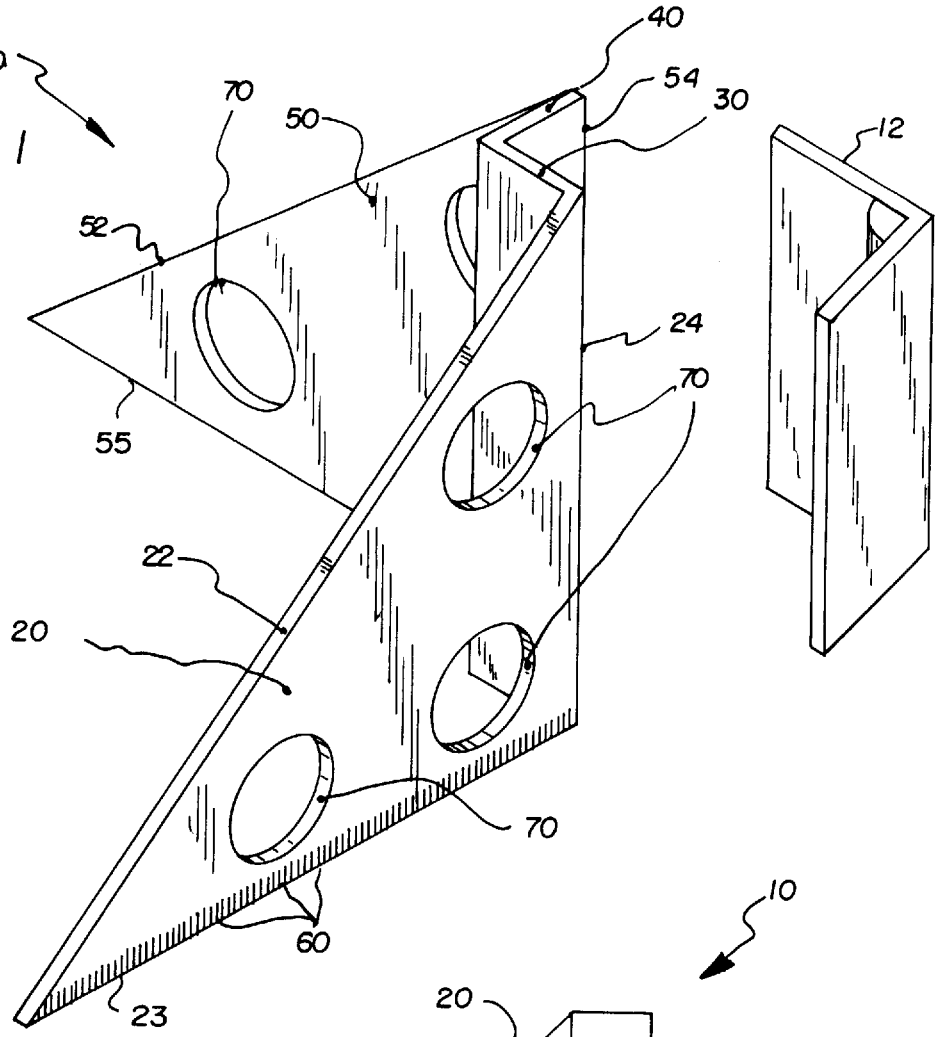
FIG. 1 is an upper side perspective view of a new Bat according to the present invention.

With reference now to the drawings, and in particular to FIGS. 1 through 6 thereof, a new Bat embodying the principles and concepts of the present invention and generally designated by the reference numeral 10 will be described.

As shown in FIGS. 1 through 4, a bat 10 is disclosed and shown having a first plate 20 that has a first vertical edge 24 and a first horizontal edge 23 connected to said first vertical edge 24. There is a first slanted edge 22 connected to said first vertical edge 24 and to said first horizontal edge 23. A first member 30 is secured to said first vertical edge 24 and said first member 30 extends orthogonally away from said first plate 20. A second member 40 is secured orthogonally to said first member 30 opposite of said first plate 20 and forms a V-shaped channel for positioning around an arcuate corner or formed interior edge as shown in FIG. 1.

There is a second plate 50 that has a second vertical edge 54 and a second horizontal edge 55 connected to said second vertical edge 54. A second slanted edge 52 is connected to said second vertical edge 54 and to said second horizontal edge 55. The second vertical edge 54 is secured orthogonally to said second member 40 opposite of said first member 30 thereby forming a W-shape wherein said first plate 20 is orthogonally aligned with respect to said second plate 50.

More specifically, it will be noted that the Bat 10 comprises a first plate 20 having a slanted edge 22, a first member 30 secured to the first plate 20, a second member 40 secured to the first member 30 forming a syncline shape or V-shape which receives arcuate corners and formed edges of an angled work piece 12, and a second plate 50 secured to said second member 40.

Figure 2:
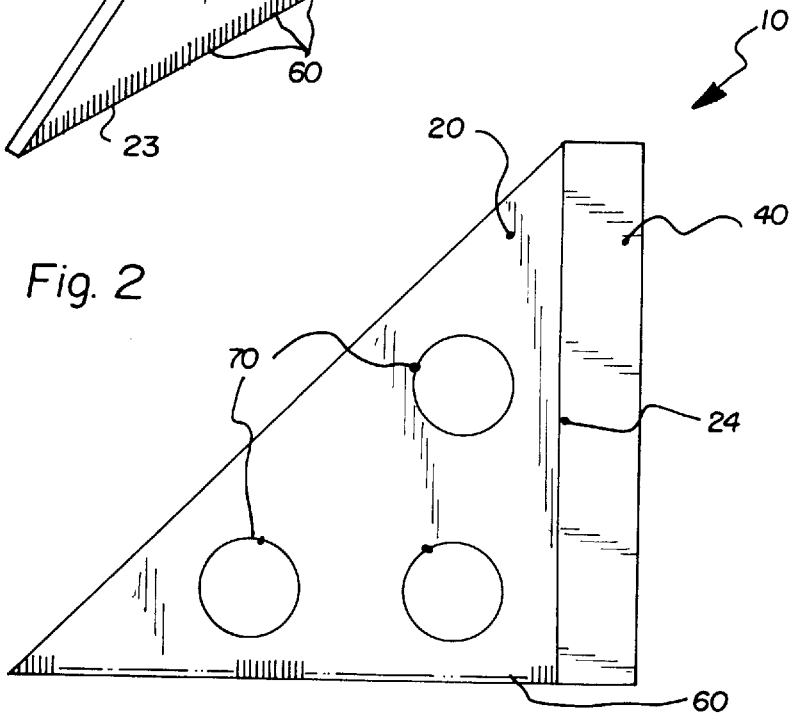
FIG. 2 is a side view of the present invention.
Figure 3:
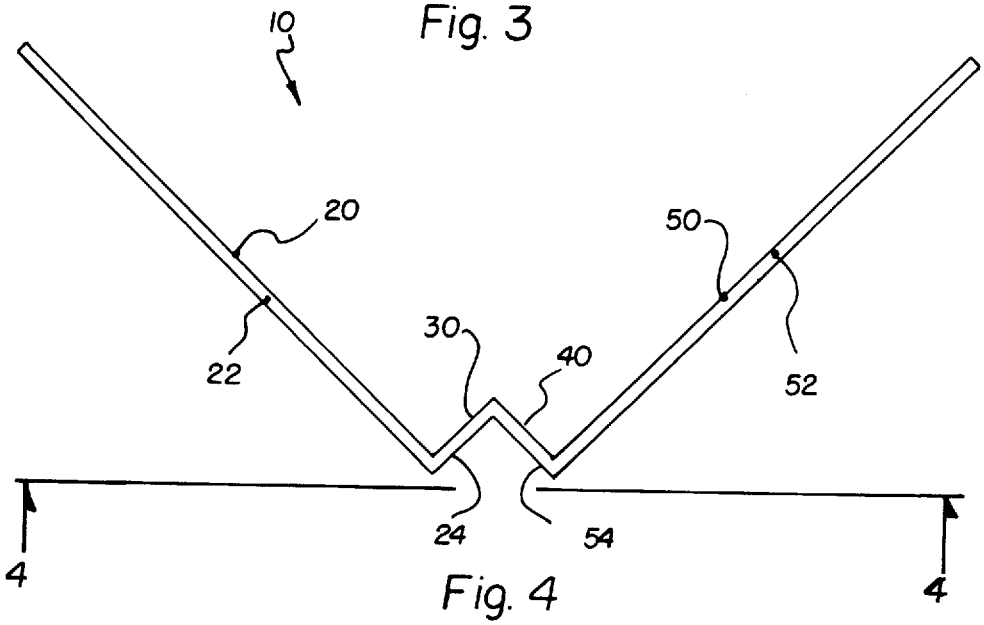
FIG. 3 is a top view of the present invention.

As best shown in FIGS. 1 and 2 of the drawings, the first slanted edge 22 projects at an angle from said first vertical edge 24 to said first horizontal edge 23. The second slanted edge 52 projects at said angle from said second vertical edge 54 to said second horizontal edge 55. The angle is preferably 45 degrees.

There is a plurality of first measurement indicia 60 secured near a lower portion of said first plate 20. The first measurement indicia 60 are spaced apart from each other. There is a plurality of second measurement indicia not shown but similar to the first measurement indicia 60 secured near a lower portion of said second plate 50. The second measurement indicia are spaced apart from each other. The distance is preferably an ⅛ of an inch.

Figure 4:
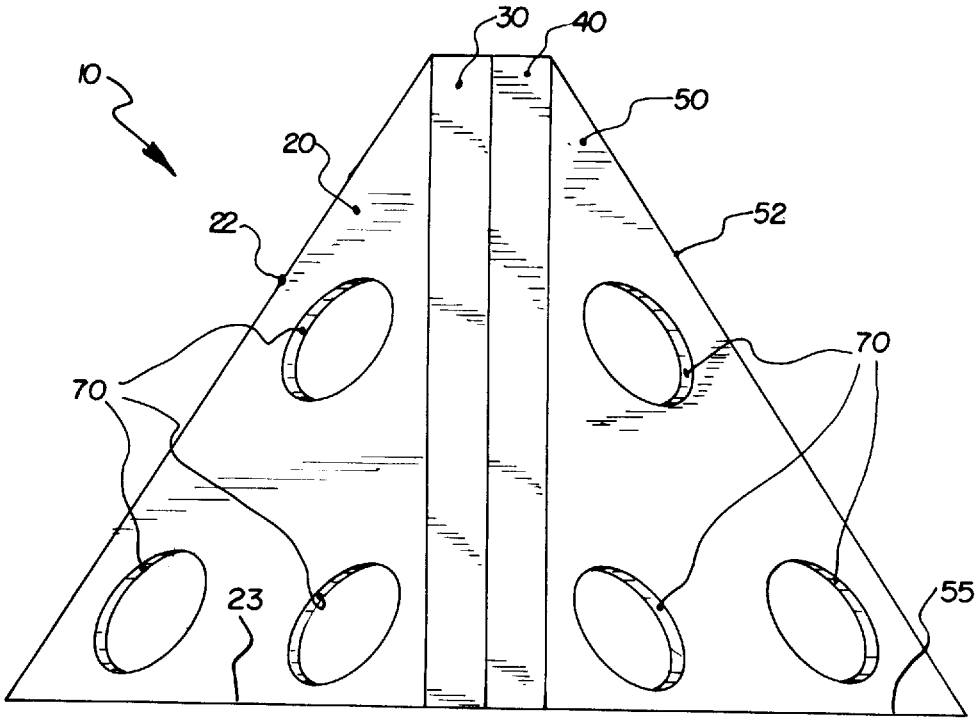
FIG. 4 is a cross sectional view taken along line 4—4 of FIG. 3.
Figure 5:
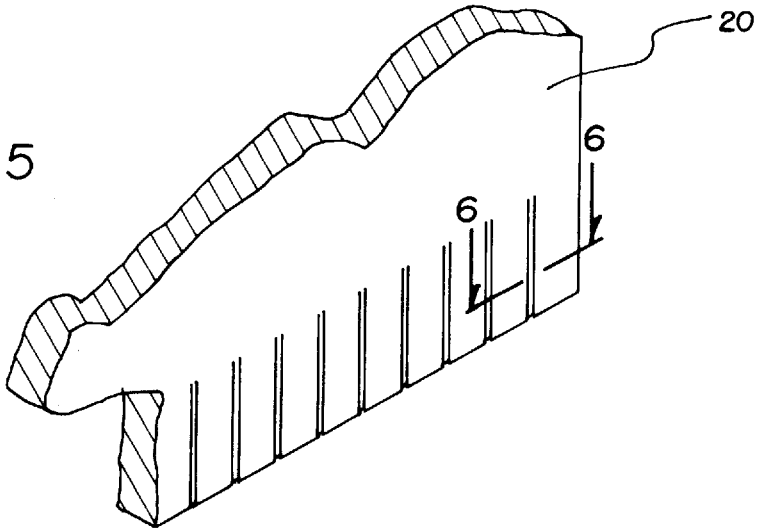
FIG. 5 is a magnified upper perspective view from FIG. 1.
Figure 6:
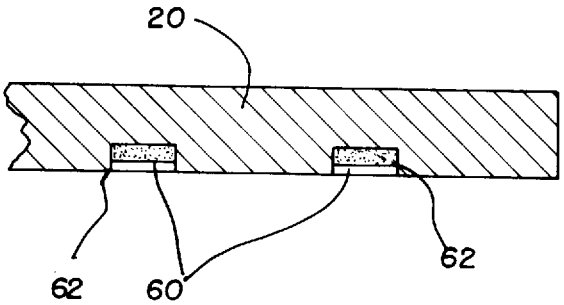
FIG. 6 is a cross sectional view taken along line 6—6 of FIG. 5.

As shown in FIGS. 1, 2 and 4, a plurality of various sized apertures 70 project through the first plate 20 and the second plate 50. The apertures 70 receive an unnumbered cylindrical object, such as a pipe, and allows the user to mark around the outer perimeter.

In use, the user positions the present invention within the interior portion of the angled work piece 12. The syncline or V-shaped channel formed by the first and second members 30, 40 receives the arcuate corner or formed edge of the angled work piece 12 to allow the first plate 20 and the second plate 50 to become juxtaposed to the interior swaged surfaces of the angled work piece 12. The user then is able to mark a straight line along the interior surfaces of the angled work piece 12 for cutting or alignment with another object.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A bat comprising:

a first plate having a first vertical edge and a first horizontal edge connected to said first vertical edge;

a first slanted edge connected to said first vertical edge and to said first horizontal edge;

a first member securing to said first vertical edge extending orthogonally away from said first plate;

a second member securing orthogonally to said first member opposite of said first plate forming a V-shaped channel for positioning around an arcuate corner or formed interior edge;

a second plate having a second vertical edge and a second horizontal edge connected to said second vertical edge;

a second slanted edge connected to said second vertical edge and to said second horizontal edge; and said second vertical edge securing orthogonally to said second member opposite of said first member thereby forming a W-shape wherein said first plate is orthogonally aligned with respect to said second plate.

2. The bat of claim 1, wherein:

said first slanted edge projects at an angle from said first vertical edge to said first horizontal edge; and said second slanted edge projects at said angle from said second vertical edge to said second horizontal edge.

3. The bat of claim 1, further comprising:

a plurality of first measurement indicia secured near a lower portion of said first plate; and said first measurement indicia are spaced apart from each other;

a plurality of second measurement indicia secured near a lower portion of said second plate; and said second measurement indicia are spaced apart from each other.

4. The bat of claim 2, wherein said angle is 45 degrees.

5. The bat of claim 3, wherein said first measurement indicia are spaced apart from each other ⅛ of an inch; and said second measurement indicia are spaced apart from each other ⅛ of an inch.

6. A bat comprising:

a first plate having a first vertical edge and a first horizontal edge connected to said first vertical edge;

a first slanted edge connected to said first vertical edge and to said first horizontal edge;

a first member securing to said first vertical edge extending away from said first plate;

a second member securing to said first member opposite of said first plate forming a V-shaped channel for positioning around an arcuate corner or formed interior edge;

a second plate having a second vertical edge and a second horizontal edge connected to said second vertical edge;

a second slanted edge connected to said second vertical edge and to said second horizontal edge; and said second vertical edge securing to said second member opposite of said first member thereby forming a W-shape.

7. The bat of claim 6, wherein:

said first slanted edge projects at an angle from said first vertical edge to said first horizontal edge; and said second slanted edge projects at said angle from said second vertical edge to said second horizontal edge.

8. The bat of claim 6, further comprising:

a plurality of first measurement indicia secured near a lower portion of said first plate; and said first measurement indicia are spaced apart from each other;

a plurality of second measurement indicia secured near a lower portion of said second plate; and said second measurement indicia are spaced apart from each other.

9. The bat of claim 7, wherein said angle is 45 degrees.

10. The bat of claim 8, wherein said first measurement indicia are spaced apart from each other ⅛ of an inch; and said second measurement indicia are spaced apart from each other ⅛ of an inch.

11. The bat of claim 6, wherein a plurality of various sized apertures project through said first plate and said second plate through which various sized cylindrical objects are received in order to place a mark on said cylindrical objects.

* * * * *